US008371706B2

(12) United States Patent
Takahashi et al.

(10) Patent No.: US 8,371,706 B2
(45) Date of Patent: Feb. 12, 2013

(54) LIGHT PROJECTION STRUCTURE AND LIGHTING APPARATUS

(75) Inventors: Koji Takahashi, Osaka (JP); Katsuhiko Kishimoto, Osaka (JP); Yasuo Fukai, Osaka (JP); David Montgomery, Oxford (GB); James Suckling, Oxford (GB)

(73) Assignee: Sharp Kabushiki Kaisha, Osaka-shi (JP)

( * ) Notice: Subject to any disclaimer, the term of this patent is extended or adjusted under 35 U.S.C. 154(b) by 0 days.

(21) Appl. No.: 13/221,488

(22) Filed: Aug. 30, 2011

(65) Prior Publication Data

US 2012/0051027 A1 Mar. 1, 2012

(30) Foreign Application Priority Data

Aug. 31, 2010 (JP) ..... 2010-193300

(51) Int. Cl.
*F21V 9/16* (2006.01)
*F21V 7/06* (2006.01)

(52) U.S. Cl. ..... 362/84; 362/293; 362/296.08

(58) Field of Classification Search ..... 362/94, 362/259, 293, 296.05, 296.08
See application file for complete search history.

(56) References Cited

U.S. PATENT DOCUMENTS

| | | | | |
|---|---|---|---|---|
| 5,418,384 | A | 5/1995 | Yamana et al. | |
| 7,165,871 | B2 | 1/2007 | Takeda et al. | |
| 7,695,164 | B2 * | 4/2010 | Berben et al. | 362/84 |
| 2007/0274096 | A1 * | 11/2007 | Chew et al. | 362/84 |

FOREIGN PATENT DOCUMENTS

| | | |
|---|---|---|
| JP | 4-34802 | 2/1992 |
| JP | 5-316296 | 11/1993 |
| JP | 2004-241142 | 8/2004 |
| JP | 2004-354495 | 12/2004 |
| JP | 2005-150041 | 6/2005 |
| JP | 2008-16412 | 1/2008 |
| JP | 2009-105125 | 5/2009 |
| JP | 2009-266437 | 11/2009 |
| JP | 2010140674 A * | 6/2010 |

* cited by examiner

*Primary Examiner* — Y My Quach Lee
(74) *Attorney, Agent, or Firm* — Morrison & Foerster LLP

(57) ABSTRACT

Provided is a light projection structure (10), including: a reflective member (11) including a reflective surface (11*a*), the reflective surface (11*a*) being formed as a concave surface having a focal point (f) positioned near its apex (t); and a light emitting member (12) disposed at the focal point (f) and its vicinity, for emitting light when excited by excitation light.

4 Claims, 10 Drawing Sheets

1

LIGHT PROJECTION STRUCTURE AND LIGHTING APPARATUS

This application is based on Japanese Patent Application No. 2010-193300 filed on Aug. 31, 2010, the contents of which are hereby incorporated by reference.

BACKGROUND OF THE INVENTION

1. Field of the Invention

The present invention relates to a light projection structure in which a reflective member reflects light emitted from a light emitting member disposed at a focal point and projects the light, and to a lighting apparatus including the light projection structure.

2. Description of Related Art

A light projection structure including a reflective member (reflection mirror) and a light emitting member is well known. The reflective member has a reflective surface, which is formed as a concave surface such as a paraboloid. The light emitting member is disposed at a focal point of the reflective member and contains a fluorescent material. The fluorescent material is excited so that light is emitted from the light emitting member. The reflective member reflects the light. The light projection structure projects substantially parallel rays.

In a conventional example, the reflective member has a shallow reflective surface, in which its focal point is positioned at an exit of the reflective member, and the light emitting member is disposed at the focal point (e.g., U.S. Pat. No. 7,165,871).

In another conventional example, the reflective member has a reflective surface having an intermediate depth, in which its focal point is positioned inside the reflective member, and the light emitting member is disposed at the focal point (e.g., Japanese Patent Application Laid-open No. 2004-354495).

Even if the depth of the reflective surface is different, parallel rays can be projected from the light projection structure as long as the light emitting member is a complete point light source and is disposed at the focal point. However, the light emitting member has a certain size. It is impossible to realize an optically ideal, complete point light source.

Conventionally, there has been no discussion about optical efficiency of the reflective member with respect to a light source which is not optically complete point light source but has a certain size, in terms of relationship with a depth of the reflective surface and a position of the light emitting member.

SUMMARY OF THE INVENTION

An object of the present invention is to provide a light projection structure having high optical efficiency of a reflective member and provide a lighting apparatus including the light projection structure.

In order to achieve the above-mentioned object, a light projection structure according to the present invention includes: a reflective member including a reflective surface, the reflective surface being formed as a concave surface having a focal point positioned near its apex; and a light emitting member disposed at the focal point and its vicinity, for emitting light when excited by excitation light.

In this configuration, the reflective surface has a half-spindle shape including a side surface part formed of a gentle curve and an apex part formed of a steep curve. Most part of the reflective surface is the gentle curve. Even light rays that are emitted from a position shifted from the focal point position of the light emitting member and enter the gentle curve part are projected at an angle relatively close to the light rays emitted from the focal point position. Therefore, optical efficiency of the reflective member can be improved in particular for a light emitting member that is not a complete point light source but has the size.

Further, the light emitting member is mounted onto an apex part of the reflective surface. According to this configuration, because the light emitting member can be mounted directly onto the reflective member, it is not necessary to provide a member for holding the light emitting member at the focal point of the reflective surface. Therefore, optical losses of the light emitting member and the reflective member become very small. Thus, optical efficiency of the reflective surface is improved. In addition, heat generated from the light emitting member is transferred to the reflective member so that the heat can be radiated efficiently from the surface of the reflective member.

Further, the reflective surface is formed in a paraboloid of revolution. According to this configuration, because the projected light rays become substantially parallel rays, the light can reach far.

Further, the reflective surface is formed in such a shape that is cut by a plane including an axis connecting the apex and the focal point. According to this configuration, the focal point position of the reflective surface can be accessed easily, and hence the optical efficiency of the reflective member is improved. In addition, the size of the light projection structure can be reduced to half the size of a rotationally symmetric reflective surface, and hence downsizing can be realized.

Further, a light emitting member containing a fluorescent material can be preferably used as the light emitting member. When the light projection structure of the present invention is used for illumination, it is preferred that the projected light be white color light. For instance, it is preferred to mix fluorescent light with excitation light so that white color light is projected, or to mix fluorescent light rays having different colors so that white color light is projected.

Further, laser light can be preferably used as the excitation light. In this case, the area of the part of the light emitting member where the excitation light enters can be reduced, and hence the size of the light emitting member can be reduced.

Further, a lighting apparatus according to the present invention includes: the above-mentioned light projection structure; and an excitation light source for emitting the excitation light. According to this configuration, the light projection structure of the present invention can be used as a headlight of a moving body such as a car, a railway car, an airplane, or a ship, or a light source for a projector.

According to the present invention, the optical efficiency of the reflective member can be enhanced for a light emitting member that is not a complete point light source but has the size.

DETAILED DESCRIPTION OF PREFERRED EMBODIMENTS

Hereinafter, embodiments of the present invention are described with reference to the attached drawings.

<Light Projection Structure>

Figure 1:
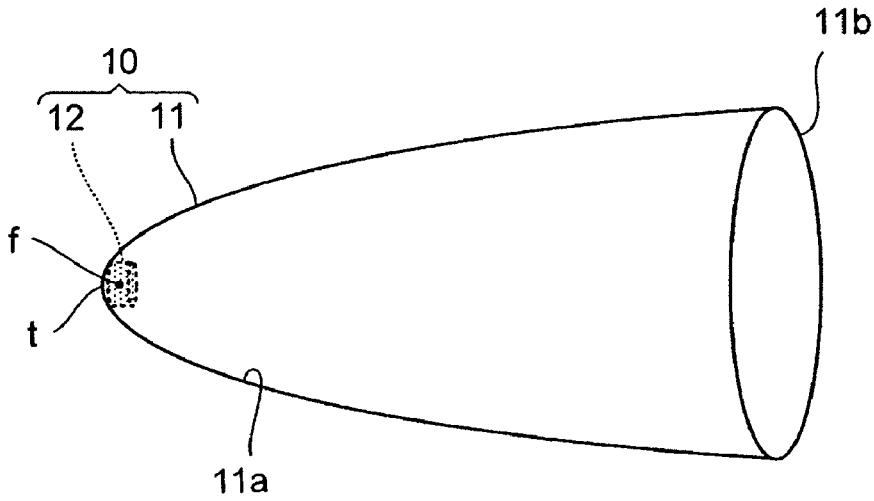
FIG. 1 is a schematic diagram illustrating an example of a light projection structure of the present invention.

FIG. 1 is a schematic diagram illustrating an example of a light projection structure according to the present invention. As illustrated in FIG. 1, a light projection structure 10 of the present invention includes a reflective member 11 and a light emitting member 12. The reflective member 11 has a reflective surface 11*a*. The reflective surface 11*a* is formed in a deep concave shape having a focal point f positioned near an apex t. The light emitting member 12 is disposed at the focal point f and in the vicinity thereof, and emits light when excited by excitation light. Here, it is supposed that the reflective surface 11*a* is formed in a parabolic shape.

Figure 2:
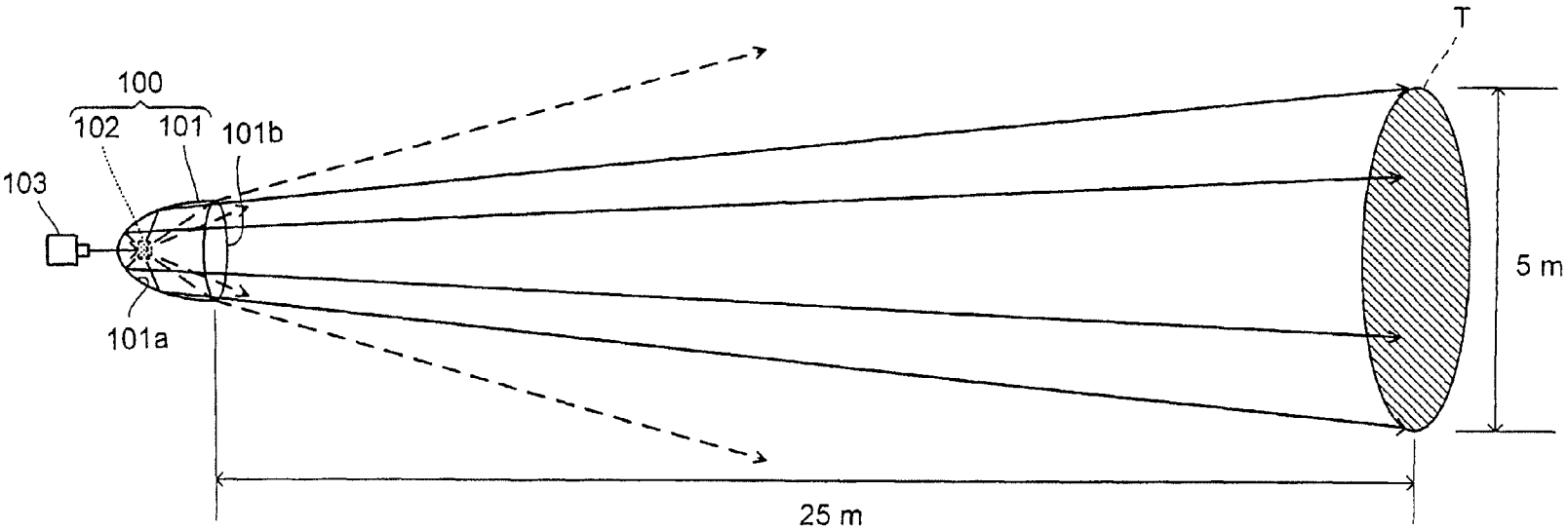
FIG. 2 is a schematic diagram of an experimental device that has proved effectiveness of the present invention.
Figure 3:
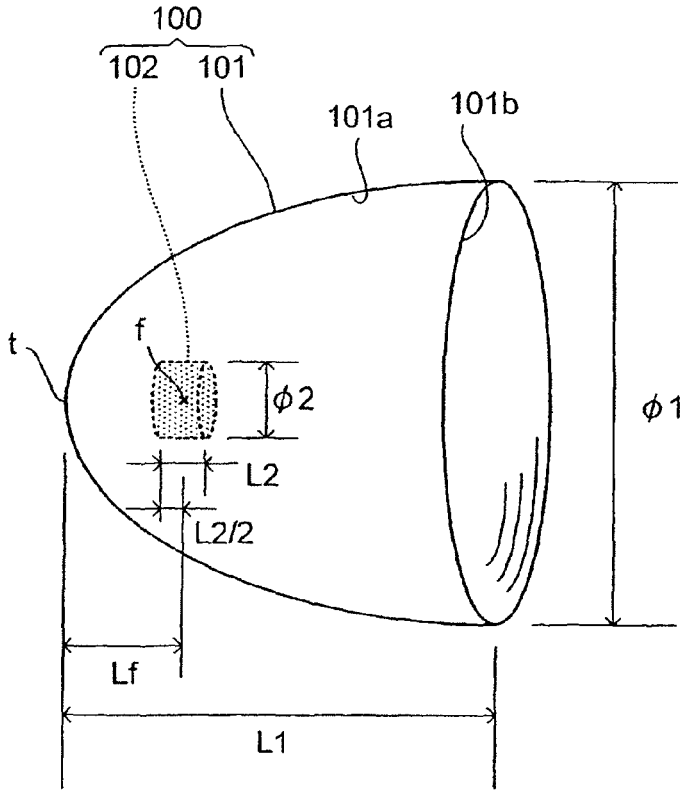
FIG. 3 is an explanatory diagram illustrating various parameters of the light projection structure used in the experiment.

First, an experiment that has proved effectiveness of the present invention is described. FIG. 2 is a schematic diagram of an experimental device. FIG. 3 is an explanatory diagram illustrating various parameters of the light projection structure used in the experiment.

As illustrated in FIGS. 2 and 3, a light projection structure 100 includes a reflective member 101 and a light emitting member 102. The reflective member 101 has a concave reflective surface 101*a*. The light emitting member 102 is disposed to occupy a focal point of the reflective surface 101*a* and the vicinity thereof.

In FIG. 2, T represents a circular target having a diameter of 5 meters (radius of 2.5 meters). The target T is disposed at a position 25 meters apart from an exit 101*b* of the reflective member 101 for light rays so as to be opposed to the exit 101*b*. The target T is orthogonal to a center axis of the reflective member 101, and the intersection thereof coincides with the center of the target T.

The position and the size of the target T are set, for example, on the assumption that the light projection structure 100 is used for a headlight of a vehicle and by simulating the target T as a person, an obstacle, a traffic sign, or the like which is to be recognized from a driver's sheet when driving the vehicle during night.

In addition, in FIG. 2, an excitation light source 103 irradiates the light emitting member 102 with excitation light. The excitation light source 103 can be a semiconductor laser element, a laser light source such as a solid-state laser or a gas laser, or a light emitting diode. The laser light source has high directivity, and hence if the laser light source is used as the excitation light source 103, the light emitting member 102 can efficiently be irradiated with light. If the semiconductor laser element is used, the light source device can be downsized. If the solid-state laser or the gas laser is used, projected light can have high intensity because of high power of the excitation light. If the light emitting diode is used, a small light source device can be realized at low cost.

The reflective member 101 reflects light emitted from the light emitting member 102 so as to project the light in a predetermined direction. The direction of the projected light depends on a geometric shape of the reflective surface 101*a*. Here, the reflective surface 101*a* has a parabolic shape, and hence the reflective member 101 projects substantially parallel rays farther away. The reflective member 101 can be manufactured, for example, by molding a resin substrate having a concave surface corresponding to the reflective surface shape, and by forming a metal layer on the concave surface of the substrate by plating or vapor deposition.

The light emitting member 102 means a member produced by any method for processing particles of a fluorescent material that absorbs the excitation light to generate fluorescent light into a bulk or to be dispersed in a bulk, such as a member produced by mixing powder of a fluorescent material together with glass or a resin and by curing the mixture, a member produced by mixing particles of a fluorescent material together with a binder and by applying the mixture, or a member produced by sintering or press-molding particles of a fluorescent material. Thus, the light emitting member 102 can be formed in any shape and any size. The fluorescent light generated from the fluorescent material reaches the surface of the light emitting member 102, and light rays exit (are radiated) from the surface in all directions.

The fluorescent material may be selected from known materials according to its use. For instance, in a case of illumination use, it is possible to use a mixture of fluorescent materials that are excited by light having a wavelength of 405 nm from the semiconductor laser element and respectively generate red color fluorescent light (e.g., $Y_2O_2S:Eu^{3+}$), green color fluorescent light (e.g., ZnS:Cu,Al), and blue color fluorescent light (e.g., $(Sr,Ca,Ba,Mg)_{10}(PO_4)_6:Eu^{2+}$), at a ratio such that the mixed color of the respective fluorescent light rays becomes white color. In addition, it is possible to use a fluorescent material that is excited by blue color light having a wavelength of 445 nm from the semiconductor laser element and generates yellow color fluorescent light (e.g., $Y_3Al_5O_{12}:Ce$), which is mixed with the blue color excitation light to produce white color.

Experiment Example 1 and Experiment Example 2 using the above-mentioned experimental device are described below. FIG. 3, Table 1, and Table 2 show various parameters of the reflective members and the light emitting members used in Experiment Examples 1 and 2.

As shown in FIG. 3 and Table 1, the reflective member 101 has the reflective surface 101*a*. Both in Experiment Examples 1 and 2, the reflective surface 101*a* is formed in a paraboloid of revolution, in which an exit diameter ϕ1 of the exit 101*b* of the reflective surface 101*a* is constant (30 mm), and a depth L1 of the reflective surface 101*a* has various values.

As shown in Table 1, a parabolic coefficient "a" is a coefficient defining the shape of a parabola ($y=ax^2$) and is proportional to the depth L1 of the reflective surface. Therefore, in a sensuous manner, as the depth L1 of the reflective surface becomes larger, the shape of the reflective surface 101*a* changes from a shallow bowl-like shape (see FIG. 8A) to a deep half-spindle shape (see FIG. 8C) via a bell-like shape having an intermediate depth (see FIG. 8B). A focal length Lf is a distance between the apex t of the reflective surface (paraboloid) and the focal point f as illustrated in FIG. 3, and is inversely proportional to the depth L1 of the paraboloid as shown in Table 1. Therefore, as the depth L1 of the reflective surface becomes larger, the focal point is closer to the apex.

As shown in FIG. 3 and Table 2, the light emitting member 102 is formed in cylindrical shapes of different sizes in Experiment Example 1 and in Experiment Example 2. As to the size of the light emitting member 102, a thickness L2 is constant (1 mm), but a diameter ϕ2 is different between Experiment Example 1 and Experiment Example 2. The diameter ϕ2 in Experiment Example 1 is 1 mm, while the diameter ϕ2 in Experiment Example 2 is 2 mm. As illustrated in FIG. 3, the light emitting member 102 is disposed so that the center position corresponds to the focal point f of the reflective surface 101*a* and that the direction of the cylinder axis coincides with a line connecting the apex t of the reflective surface 101*a* and the focal point f. According to this arrangement, the light emitting member 102 occupies the focal point f of the reflective surface and its vicinity.

TABLE 1

| | Shape | Reflectance | Exit diameter ϕ1 | Depth L1 | Parabolic coefficient a $y = ax^2$ | Focal length Lf Lf = 1/(4a) |
|---|---|---|---|---|---|---|
| Experiment Examples 1 and 2 | Paraboloid of revolution | 90% | 30 mm | Variable | L1/225 | 225/(4L1) |

| | Shape | Diameter ϕ2 | Thickness L2 |
|---|---|---|---|
| Experiment Example 1 | Cylinder | 1 mm | 1 mm |
| Experiment Example 2 | Cylinder | 2 mm | 1 mm |

Figure 4:
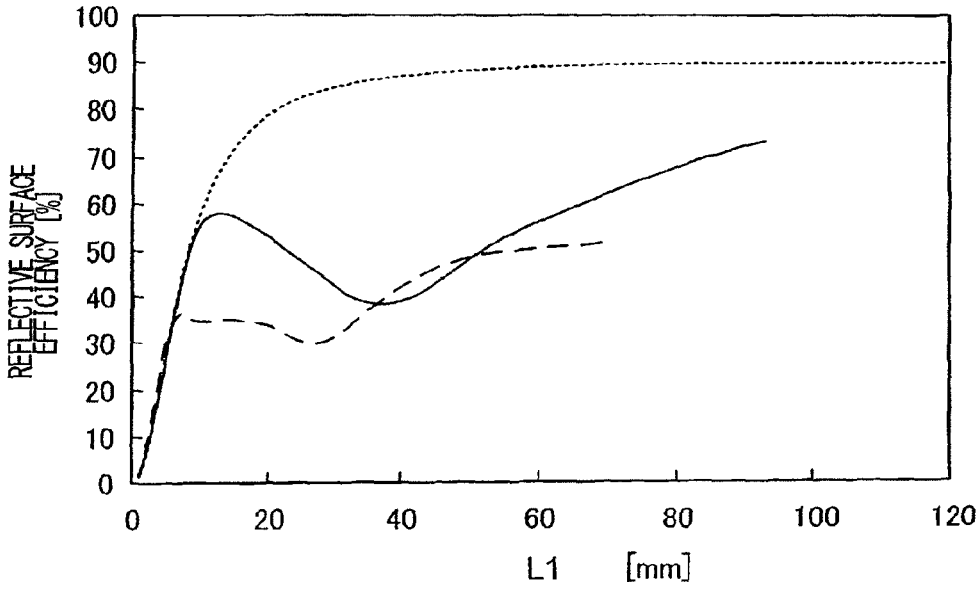
FIG. 4 is a graph obtained by plotting results of the experiment, in which the horizontal axis indicates a depth of a reflective surface and the vertical axis indicates reflective surface efficiency.

In Experiment Example 1 and Experiment Example 2, light beams entering the target T (see FIG. 2) were measured. Then, a ratio of the light beams entering the target T to all light beams emitted from the light emitting member 102 is defined as "reflective surface efficiency". FIG. 4 illustrates a graph obtained by plotting results of the experiment in each of Experiment Example 1 and Experiment Example 2, in which the horizontal axis indicates the depth L1 of the reflective surface (see FIG. 3) and the vertical axis indicates the reflective surface efficiency. FIG. 4 also illustrates reflective surface efficiency that is expected when the light emitting member is supposed to be a point light source.

As illustrated in FIG. 4 by a dotted line, in the case of the virtual point light source, it is expected that the reflective surface efficiency increase monotonously with respect to the depth of the reflective surface.

Figure 5A:
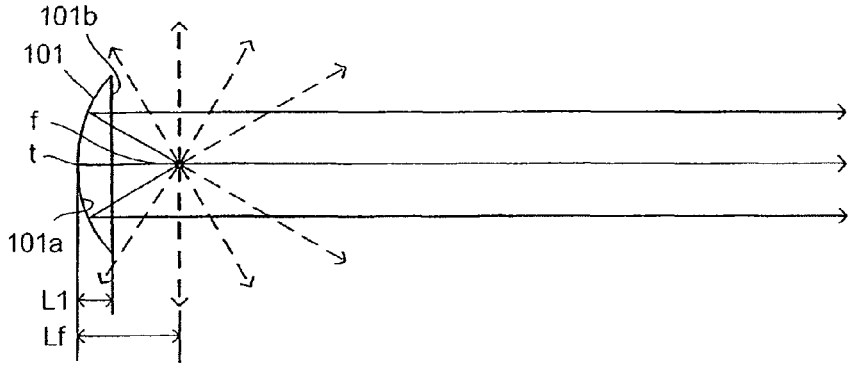
FIG. 5A is an explanatory diagram illustrating a ratio of light rays projected toward a target to light rays emitted from a focal point in a case of a significantly shallow reflective surface (the focal point is positioned outside an exit of the reflective surface).
Figure 5B:
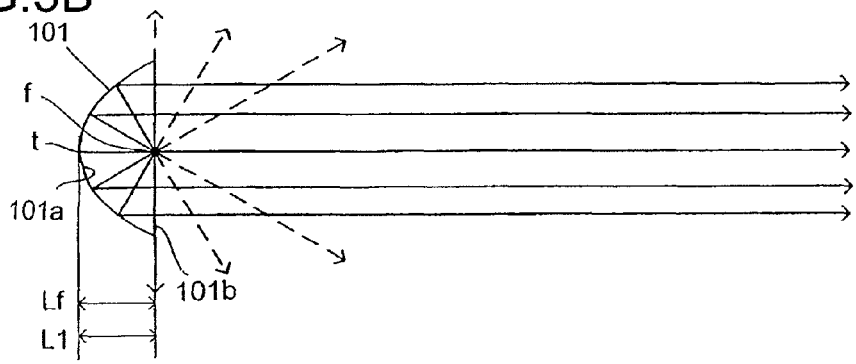
FIG. 5B is an explanatory diagram illustrating a ratio of light rays projected toward the target to light rays emitted from the focal point in a case where a distance between an apex of the reflective surface and the focal point is the same as a depth of the reflective surface.
Figure 5C:
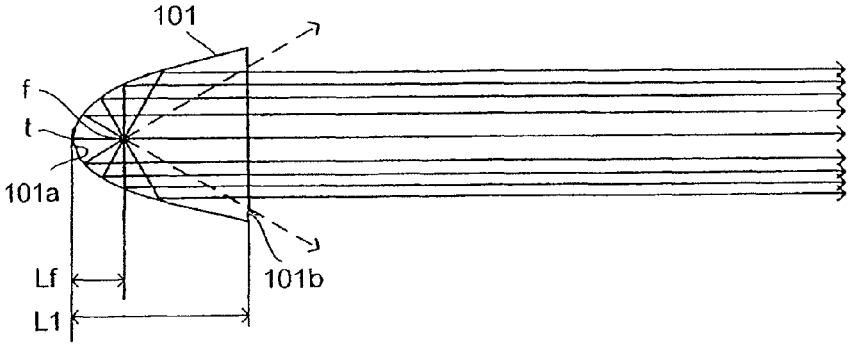
FIG. 5C is an explanatory diagram illustrating a ratio of light rays projected toward the target to light rays emitted from the focal point in a case of a deep reflective surface (the focal point is positioned inside the exit of the reflective surface).
Figure 5D:
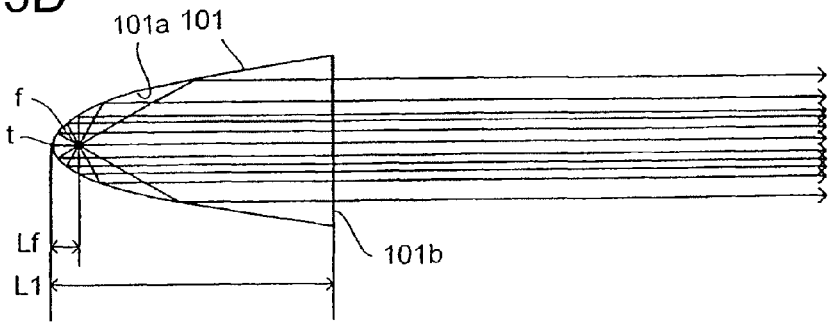
FIG. 5D is an explanatory diagram illustrating a ratio of light rays projected toward the target to light rays emitted from the focal point in a case of a deeper reflective surface (the focal point is positioned near the apex of the reflective surface).

As described above, the focal point becomes closer to the apex as the depth of the reflective surface becomes larger. As illustrated in FIG. 5A, in the case where the reflective surface 101*a* is significantly shallow, the focal point f is positioned outside the exit 101*b* of the reflective surface (Lf>L1). If the reflective surface 101*a* becomes deep, the focal point f coincides with the exit 101*b* of the reflective surface (Lf=L1, see FIG. 5B). If the reflective surface 101*a* becomes deeper, the focal point f is positioned inside the exit 101*b* of the reflective surface (see FIG. 5C). If the reflective surface 101*a* becomes much deeper, the focal point f is positioned close to the apex t (see FIG. 5D). Then, in this order, the ratio of the light rays entering the reflective surface 101*a* to light rays emitted from the focal point f in all directions increases.

This phenomenon is common to the virtual point light source and a light emitting member having the size. However, in the case of the virtual point light source, completely parallel rays should be projected from the reflective member 101. Therefore, the projected light is not diverged, and the reflected light is 100% directed to the target. Therefore, the graph shows monotonous increase as described above.

Figure 6:
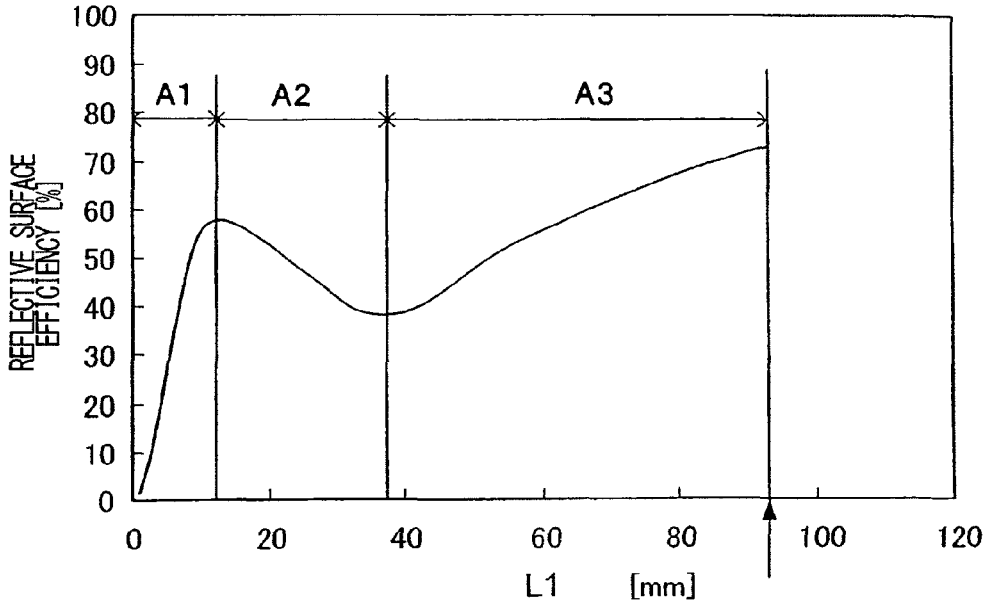
FIG. 6 is a graph in which results of Experiment Example 1 are extracted from FIG. 4.
Figure 7:
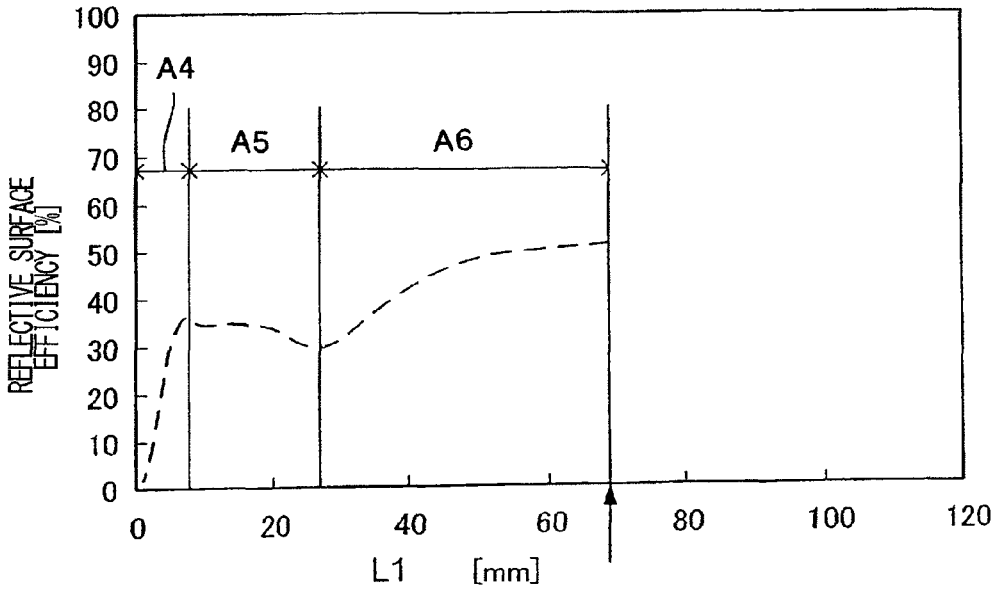
FIG. 7 is a graph in which results of Experiment Example 2 are extracted from FIG. 4.

On the other hand, in the case of Experiment Example 1 or Experiment Example 2, the light emitting member 102 has the size, and hence the light emitting member 102 cannot be regarded as a point light source. Therefore, the divergence of the projected light cannot be neglected, and the graph of the reflective surface efficiency with respect to the depth of the reflective surface does not show monotonous increase. In other words, the graph is as illustrated in FIG. 4 by a solid line (Experiment Example 1) and by a broken line (Experiment Example 2). The graph of Experiment Example 1 is extracted and illustrated in FIG. 6. The graph of Experiment Example 2 is extracted and illustrated in FIG. 7. As illustrated in FIGS. 6 and 7, it is found that if the light emitting member has the size, there is a difference in change of the reflective surface efficiency depending on a stage of the depth of the reflective surface.

More specifically, as a first stage, in a range of a shallow depth of the reflective surface (range A1 illustrated in FIG. 6 and range A4 illustrated in FIG. 7), the reflective surface efficiency increases as the depth of the reflective surface increases, and a maximum is scored at a certain depth. Then, as a second stage, in a range of an intermediate depth of the reflective surface (range A2 illustrated in FIG. 6 and range A5 illustrated in FIG. 7), the reflective surface efficiency decreases as the depth of the reflective surface increases, and a minimum is scored at a certain depth. Then, as a third stage, in a range of a deep depth of the reflective surface (range A3 illustrated in FIG. 6 and range A6 illustrated in FIG. 7), the reflective surface efficiency increases again as the depth of the reflective surface increases.

Note that, the point of maximum and the point of minimum of the reflective surface efficiency are determined by experiment and are not determined theoretically. In addition, the graph is broken because when the focal point is close to the apex, the light emitting member having the size abuts the reflective surface so that the light emitting member cannot be moved any more to a position closer to the apex. Therefore, the break point is an actual upper limit of the depth of the reflective surface (see the arrow in FIG. 6 and the arrow in FIG. 7).

This peculiar phenomenon is estimated to be caused by the following reason.

First, the depth of the parabola and the shape of the parabola are studied. As to the parabola expressed by the general equation $y=ax^2$, a curvature k at x=p is expressed by $k=2a/(1+(2ap)^2)^{2/3}$. The parabolic coefficient "a" is proportional to the depth L1 of the reflective surface (see FIG. 3). Therefore, in a sensuous manner, as the depth L1 of the reflective surface becomes larger, a part having a large curvature appears around the apex (x=0). The part having a large curvature is reduced to converge in the vicinity of the apex as the depth of the reflective surface becomes larger.

Figure 8A:
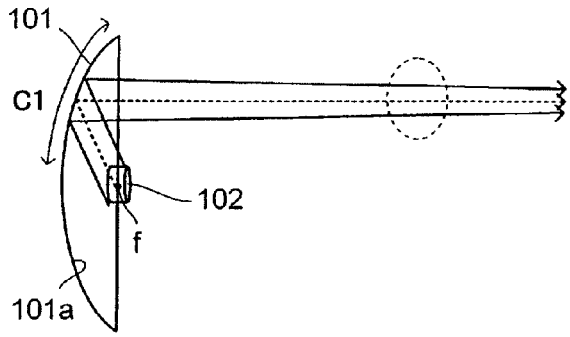
FIG. 8A is an explanatory diagram illustrating a locus of the light rays emitted in a specific direction from a light emitting member in the case of the shallow reflective surface.
Figure 8B:
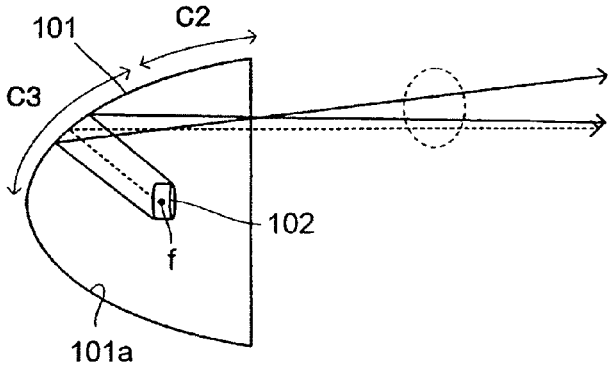
FIG. 8B is an explanatory diagram illustrating a locus of the light rays emitted in a specific direction from the light emitting member in the case of the reflective surface having an intermediate depth.
Figure 8C:
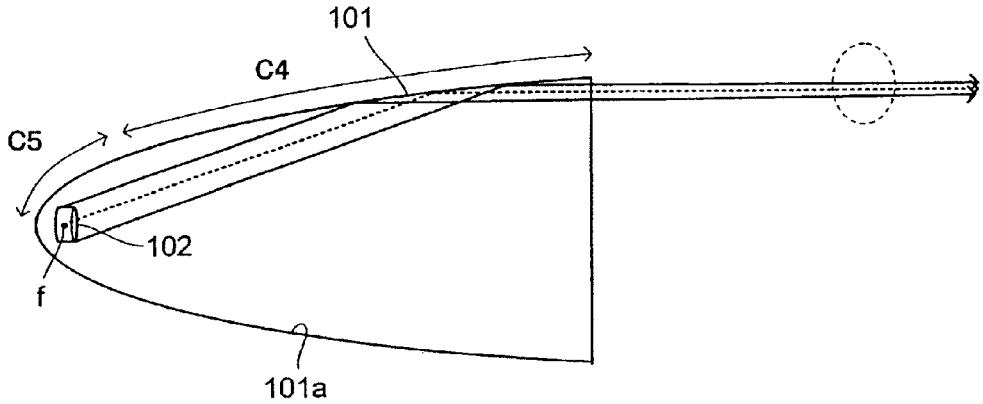
FIG. 8C is an explanatory diagram illustrating a locus of the light rays emitted in a specific direction from the light emitting member in the case of the deep reflective surface.

Under this study, description is made based on specific shapes of the reflective surface. FIGS. 8A, 8B, and 8C illustrate loci of light rays emitted from portions at both edges of the light emitting member 102 among light rays emitted from the light emitting member 102 to a specific direction. FIGS. 8A, 8B, and 8C also illustrate loci of light rays from the virtual point light source at the focal point in the same direction by dotted lines. As illustrated in FIGS. 8A, 8B, and 8C by solid lines, when the light emitting member 102 is not an ideal point light source but has the size, the light rays emitted from the light emitting member 102 exit from positions shifted from the focal point f.

In the range in which the depth of the reflective surface 101*a* is "shallow", as illustrated in FIG. 8A, the reflective surface 101*a* has a shape generally like a bowl with a relatively gentle curve of parabola. Regardless of a position where the light rays enter, the light rays emitted from a position shifted from the focal point f are projected at an angle relatively close to light rays emitted from the virtual point light source. Therefore, little light rays are deviated from the target, and it is expected to show a tendency that the reflective surface efficiency increases as the depth of the reflective surface 101*a* increases. Note that, a part C1 illustrated in FIG. 8A indicates the part with the gentle curve.

In the range in which the depth of the reflective surface 101*a* is "deep", as illustrated in FIG. 8C, the reflective surface 101*a* has a half-spindle shape including a side surface part of a gentle curve and an apex part of a steep curve. Most part of the reflective surface 101*a* is the gentle curve. The light rays entering the gentle curve part are projected at an angle relatively close to the light rays emitted from the virtual point light source, including the light rays emitted from a position shifted from the focal point f. Therefore, little light rays are deviated from the target, and it is expected to show a tendency that the reflective surface efficiency increases as the depth of the reflective surface 101*a* increases. Note that, a part C4 illustrated in FIG. 8C indicates the part with the gentle curve, and a part C5 illustrated in FIG. 8C indicates the part with the steep curve.

In contrast, in the range in which the depth of the reflective surface 101*a* is "intermediate", as illustrated in FIG. 8B, the reflective surface 101*a* has a bell shape with a small ratio of the gentle curve part compared with the deep reflective surface 101*a* (see FIG. 8C). The reflection direction of the light rays entering the steep curve part depends on a position where the light rays enter, and a shift from the parallel rays is increased due to a shift from the focal point. Therefore, more light rays are deviated from the target, and it is expected to show a tendency that the reflective surface efficiency decreases as the depth of the reflective surface increases. Note that, a part C2 illustrated in FIG. 8B indicates the part with the gentle curve, and a part C3 illustrated in FIG. 8B indicates the part with the steep curve.

As exemplified in FIG. 1, the light projection structure 10 of the present invention includes the reflective member 11 having a half-spindle shape with the focal point f positioned closer to the apex t with respect to the reflective member 101 having a deep reflective surface (see FIG. 8C). For instance, an aspect ratio (L1/ϕ1) of the reflective surface 11*a* is approximately one or larger, and the focal length (Lf) is approximately 2 mm or smaller. Note that, those numerical values express the concept specifically, but the characteristic of the reflective surface 11*a* of the reflective member 11 used in the light projection structure 10 of the present invention are not limited to those numerical values. Therefore, according to the light projection structure 10 of the present invention, it is possible to enhance optical efficiency of the reflective member 11 with respect to a light emitting member 12 that is not a complete point light source but has the size.

<Lighting Apparatus Having Light Projection Structure>

Next, embodiments of a lighting apparatus using the light projection structure of the present invention are described.

Figure 9:
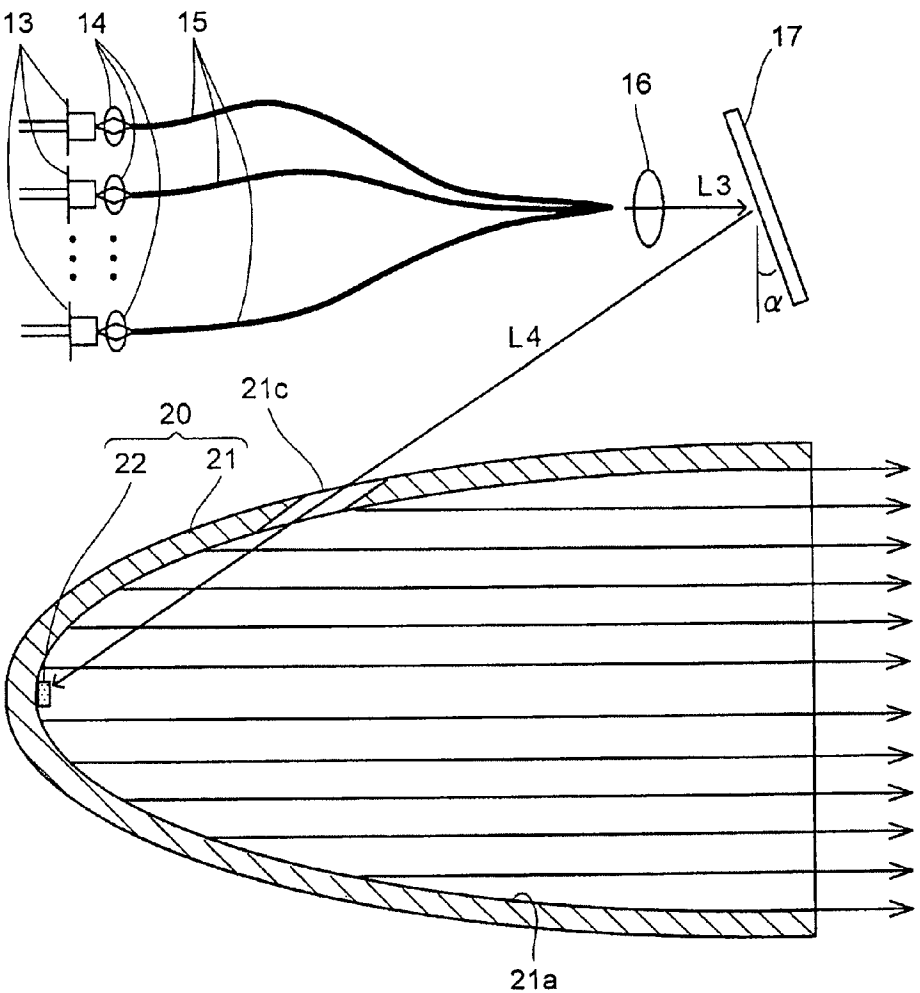
FIG. 9 is a side cross sectional view illustrating a schematic configuration of a lighting apparatus according to a first embodiment.

A first embodiment of the lighting apparatus is described. FIG. 9 is a side cross sectional view illustrating a schematic configuration of the lighting apparatus of the first embodiment.

As illustrated in FIG. 9, in this embodiment, a lighting apparatus 1 includes a light projection structure 20 of the present invention, a plurality of semiconductor laser elements (excitation light sources) 13, a plurality of condenser lenses 14 disposed corresponding to the individual semiconductor laser elements 13 for condensing laser light emitted from the semiconductor laser element 13 to an incident end of an optical fiber 15, a plurality of the optical fibers 15 disposed corresponding to the individual semiconductor laser elements 13 and the individual condenser lenses 14 for guiding the condensed laser light to be emitted, a collimator lens 16 for collimating the plurality of laser light rays emitted from the plurality of optical fibers 15, and a reflector plate 17 for reflecting the collimated light rays.

A GaN-based semiconductor laser element is used as the semiconductor laser element 13, which emits laser light of 405 nm having power of 1 W. The number of the semiconductor laser elements 13 is eight, for example.

The collimator lens 16 is disposed orthogonal to an optical axis L3 of the laser light emitted from the exit ends of the bound optical fibers 15. The reflector plate 17 is positioned in front of a through hole 21*c* formed in the side surface part of a reflective member 21. An inclination angle of the reflector plate 17 from the vertical axis (angle denoted by α in FIG. 9) is set to a value such that an optical axis L4 of the reflected laser light passes through the through hole 21*c* and is directed to the vicinity of the apex of the reflective member 21.

The light projection structure 20 includes the reflective member 21 and a light emitting member 22. The reflective member 21 includes a reflective surface 21*a*, and the reflective surface 21*a* is a paraboloid of revolution formed as a deep concave surface having its focal point positioned near the apex. The light emitting member 22 is mounted onto the apex part of the reflective member 21 and emits light when exited by the excitation light.

The reflective member 21 reflects the light emitted from the light emitting member 22 and projects substantially parallel rays to the front (rightward in the FIG. 9). The reflective member 21 can be manufactured, for example, by molding a resin substrate having a concave surface corresponding to the reflective surface shape, and by forming a metal layer on the concave surface of the substrate by plating or vapor deposition. The reflective member 21 has the through hole 21*c* in the side surface part for the laser light to irradiate the apex part of the reflective surface 21*a*. Because the reflective member has a half-spindle shape in the light projection structure of the present invention, the reflective member is suitable for providing such a through hole in the side surface part.

The reflective surface 21*a* has an exit diameter of 40 mm and a depth of 95 mm.

As the light emitting member 22, it is possible to preferably use a solid body obtained by uniformly dispersing powder of a fluorescent material that absorbs the excitation light to generate the fluorescent light into a transparent resin or glass. Thus, the light emitting member 22 can be formed in any shape and any size. The fluorescent light generated from the fluorescent material reaches the surface of the light emitting member 22, and light rays exit (are radiated) from the surface in all directions.

The light emitting member 22 has a cylindrical shape having a diameter of 3 mm and a thickness of 1 mm.

A bottom surface part of the light emitting member 22 is mounted onto the apex part of the reflective surface 21*a* with a high thermal conductivity adhesive. The high thermal conductivity adhesive is used for promoting heat radiation by transferring heat generated by the light emitting member 22 to the reflective member 21. Note that, it is preferred to form the bottom surface part of the light emitting member 22 in a dome shape corresponding to the bowl-like shape of the apex part of the reflective surface 21*a* so that the amount of the adhesive to be used can be reduced.

Because the light emitting member 22 is mounted directly onto the reflective member 21, the reflective member 21 itself can hold the light emitting member 22 without another holding member. Then, losses of the light beams emitted from the light emitting member 22 and the light beams projected from the reflective member 21 are very small. In other words, optical losses of the light emitting member 22 and the reflective member 21 become very small. Thus, optical efficiency of the reflective surface 21*a* is improved.

Note that, the light emitting member 22 having a size close to the above-mentioned size can be disposed without using an adhesive in the following way. That is, powder of the fluorescent material is uniformly mixed into a melted resin serving as a dispersion medium, and an appropriate amount of the resultant gel is dropped on the apex part of the reflective surface 21*a* of the reflective member 21 which is fixed in the vertical position with the exit up, followed by curing the gel.

Further, in this embodiment, the fluorescent materials are used, which are a mixture of fluorescent materials that are excited by light having a wavelength of 405 nm from the semiconductor laser element 13 and respectively generate red color fluorescent light (e.g., $Y_2O_2S:Eu^{3+}$), green color fluorescent light (e.g., ZnS:Cu,Al), and blue color fluorescent light (e.g., $(Sr,Ca,Ba,Mg)_{10}(PO_4)_6:Eu^{2+}$), at a ratio such that the mixed color of the respective fluorescent light rays becomes white color.

In this embodiment, the lighting apparatus 1 includes the light projection structure 20 of the present invention, and therefore can enhance optical efficiency of the reflective member 21 with respect to the light emitting member 22 that is not a complete point light source but has the size, to thereby illuminate a target in a distance brightly. In addition, because laser light is used as the excitation light source, the lighting apparatus can be made compact.

In addition, because the light emitting member 22 contacts with the reflective surface 21*a* via the high thermal conductivity adhesive layer, heat of the light emitting member 22 can be radiated via the reflective member 21. Therefore, without disposing another heat radiation structure for the light emitting member 22, it is possible to reduce thermal quenching of the fluorescent material.

Figure 10:
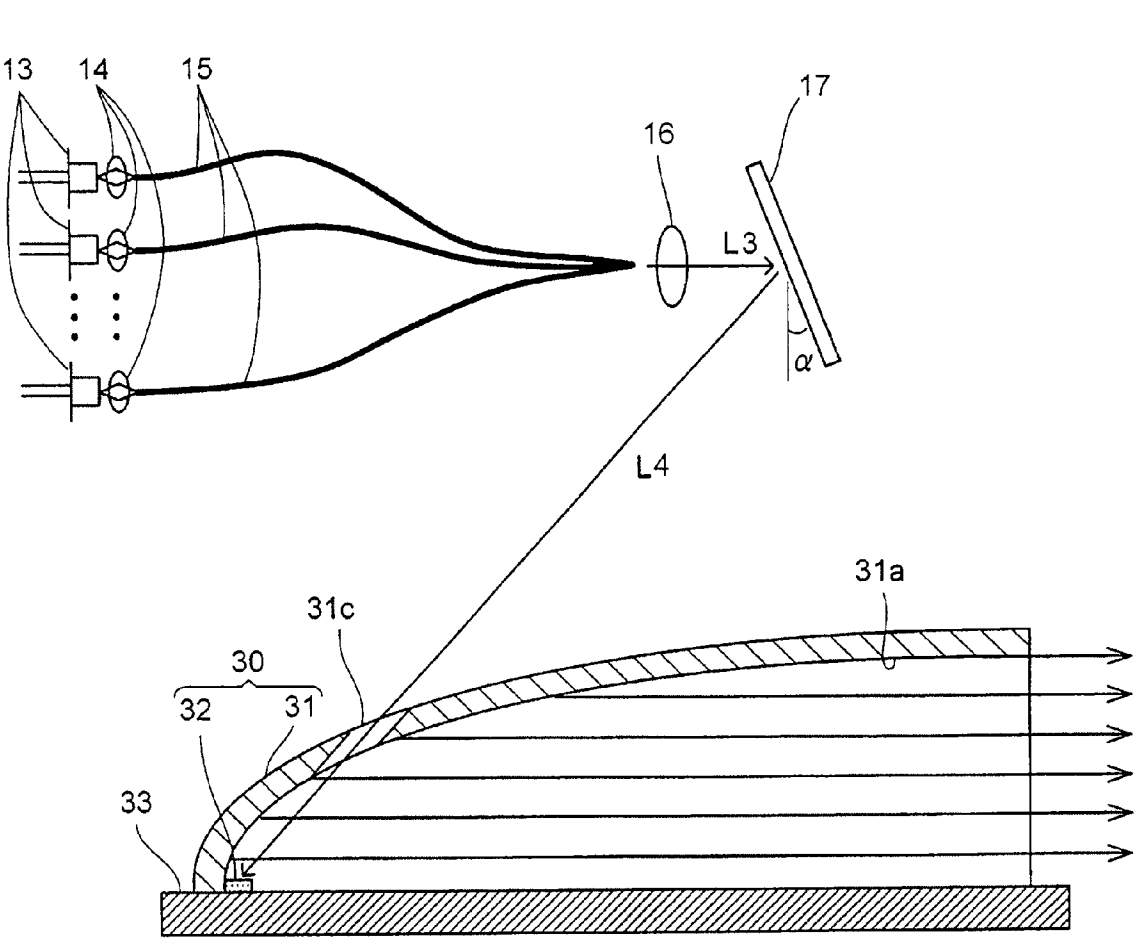
FIG. 10 is a side cross sectional view illustrating a schematic configuration of a lighting apparatus according to a second embodiment.

Next, a second embodiment of the lighting apparatus is described. FIG. 10 is a side cross sectional view illustrating a schematic configuration of the lighting apparatus of the second embodiment.

As illustrated in FIG. 10, in this embodiment, a lighting apparatus 2 includes a light projection structure 30 of the present invention, and a reflective member 31 of the light projection structure 30 has a reflective surface 31*a*. The reflective surface 31*a* has such a shape that is cut by a plane including an axis connecting the apex of a paraboloid of revolution and the focal point. The reflective member 31 is disposed on a metal substrate 33.

The reflective member 31 reflects light emitted from a light emitting member 32 and projects substantially parallel rays to the front (rightward in FIG. 10). The reflective member 31 can be manufactured, for example, by molding a resin substrate having a concave surface corresponding to the reflective surface shape, and by forming a metal layer on the concave surface of the substrate by plating or vapor deposition. The reflective member 31 has a through hole 31*c* in the side surface part for the laser light to irradiate the apex part of the reflective surface 31*a*. Because the reflective member has a half-spindle shape in the light projection structure of the present invention, the reflective member is suitable for providing such a through hole in the side surface part.

As to the size of the reflective member 31, the exit is a semicircle having a radius of 20 mm, and the depth is 95 mm. This is half the size of the reflective member 21 used in the first embodiment.

In this embodiment, the light emitting member 32 is the same as the light emitting member 22 used in the first embodiment.

The side surface part of the light emitting member 32 is mounted onto the apex part of the reflective surface 31*a* with a high thermal conductivity adhesive. Note that, the bottom surface part of the light emitting member 32 may be mounted onto the substrate 33 with a high thermal conductivity adhesive. In this case, the light emitting member 32 can be securely mounted because of the increased adhesion area. In addition, as illustrated in FIG. 10, the incident surface (upper surface in FIG. 10) of the light emitting member 32 for the laser light is opposite to the side surface of the reflective member 31, and it is easy to set an incident angle of the laser light entering through the through hole 31*c* from the outside of the side surface of the reflective member 31 to an acute angle.

Other configuration of the lighting apparatus 2 in this embodiment is the same as that of the first embodiment.

In particular, according to the lighting apparatus 2 of this embodiment, the same effect as in the lighting apparatus 1 of the first embodiment is obtained, and in addition, the following unique effect can be obtained.

Because the reflective surface 31*a* of the reflective member 31 is half the size of the paraboloid of revolution, the lighting apparatus can be made more compact.

In addition, heat generated by the light emitting member 32 can be radiated not only via the reflective member 31 but also via the metal substrate 33. Therefore, thermal quenching of the fluorescent material can be reduced more effectively.

Figure 11:
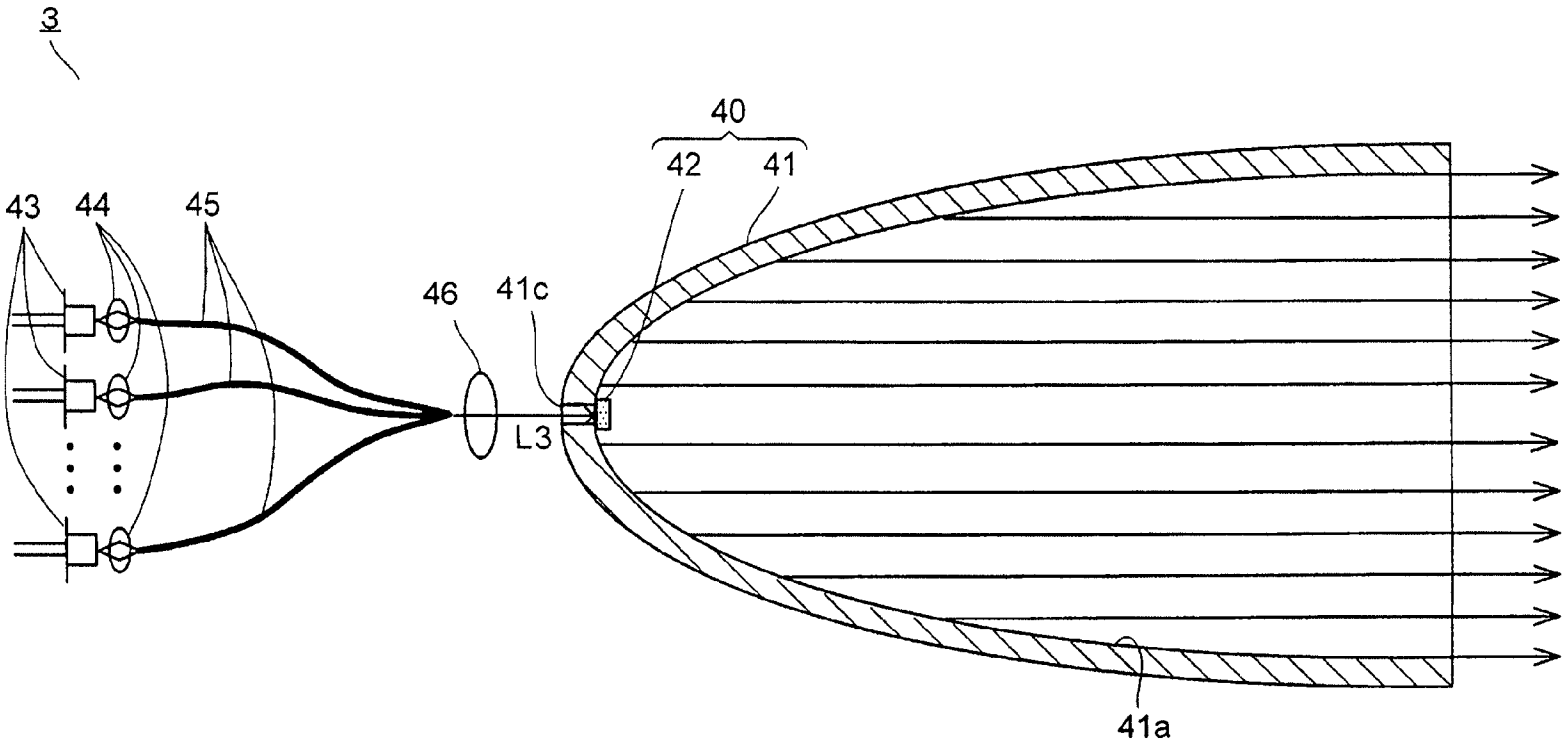
FIG. 11 is a side cross sectional view illustrating a schematic configuration of a lighting apparatus according to a third embodiment.

Next, a third embodiment of the lighting apparatus is described. FIG. 11 is a side cross sectional view illustrating a schematic configuration of the lighting apparatus of the third embodiment.

As illustrated in FIG. 11, in this embodiment, a lighting apparatus 3 includes a light projection structure 40 of the present invention, a plurality of semiconductor laser elements (excitation light sources) 43, a plurality of condenser lenses 44 disposed corresponding to the individual semiconductor laser elements 43 for condensing laser light emitted from the semiconductor laser element 43 to an incident end of an optical fiber 45, a plurality of the optical fibers 45 disposed corresponding to the individual semiconductor laser elements 43 and the individual condenser lenses 44 for guiding the condensed laser light to be emitted, and a collimator lens 46 for collimating the plurality of laser light rays emitted from the plurality of optical fibers 45.

A GaN-based semiconductor laser element is used as the semiconductor laser element 43, which emits laser light of 445 nm having power of 1 W. The number of the semiconductor laser elements 43 is six, for example. Note that, a GaN-based semiconductor laser element that emits laser light of 405 nm having power of 1 W may be used as the semiconductor laser element 43 similarly to the lighting apparatus 1 of the first embodiment.

The collimator lens 46 is disposed orthogonal to an optical axis L3 of the laser light emitted from the exit ends of the bound optical fibers 45. The laser light condensed by the collimator lens 46 is set to have an angle such that the laser light passes through a through hole 41*c* and is directed to the vicinity of the apex of the reflective member 41.

The light projection structure 40 includes the reflective member 41 and a light emitting member 42. The reflective member 41 includes a reflective surface 41*a*, and the reflective surface 41*a* is a paraboloid of revolution formed as a deep concave surface having its focal point positioned near the apex. The light emitting member 42 is mounted onto the apex part of the reflective member 41 and emits light when exited by the excitation light.

The reflective member 41 reflects the light emitted from the light emitting member 42 and projects substantially parallel rays to the front (rightward in FIG. 11). The reflective member 41 can be manufactured, for example, by molding a resin substrate having a concave surface corresponding to the reflective surface shape, and by forming a metal layer on the concave surface of the substrate by plating or vapor deposition. The reflective member 41 has the through hole 41*c* in the apex part for the laser light to irradiate the apex part of the reflective surface 41*a*.

The reflective surface 41*a* has an exit diameter of 50 mm and a depth of 120 mm. In addition, the through hole 41*c* is a round hole having a diameter smaller than 4 mm.

As the light emitting member 42, it is possible to preferably use a solid body obtained by uniformly dispersing powder of a fluorescent material that absorbs the excitation light to generate the fluorescent light into a transparent resin or glass. Thus, the light emitting member 42 can be formed in any shape and any size. The fluorescent light generated from the fluorescent material reaches the surface of the light emitting member 42, and light rays exit (are radiated) from the surface in all directions.

The light emitting member 42 has a cylindrical shape having a diameter of 4 mm and a thickness of 1 mm.

A bottom surface part of the light emitting member 42 is mounted onto a peripheral portion of the through hole 41*c* in the apex part of the reflective surface 41*a* with a high thermal conductivity adhesive. The high thermal conductivity adhesive is used for promoting heat radiation by transferring heat generated by the light emitting member 42 to the reflective member 41. Note that, it is preferred to form the bottom surface part of the light emitting member 42 in a dome shape corresponding to the bowl-like shape of the apex part of the reflective surface 41*a* so that the amount of the adhesive to be used can be reduced.

Because the light emitting member 42 is directly mounted onto the reflective member 41, another holding member is not necessary. Thus, optical losses of the light emitting member 42 and the reflective member 41 become very small. Thus, optical efficiency of the reflective surface is improved.

Note that, the light emitting member 42 having a size close to the above-mentioned size can be disposed without using an adhesive in the following way. That is, powder of the fluorescent material is uniformly mixed into a melted resin serving as a dispersion medium, and an appropriate amount of the resultant gel is dropped on the apex part of the reflective surface 41*a* of the reflective member 41 which is fixed in the vertical position with an exit 41*b* of the reflective surface 41*a* up, followed by curing the gel.

A fluorescent material that is excited by blue color light having a wavelength of 445 nm from the semiconductor laser element 43 to generate yellow color fluorescent light (e.g., $Y_3Al_5O_{12}$:Ce) is used. The yellow color fluorescent light generated from the fluorescent material is mixed with the excitation light of blue color to produce white color. In this embodiment, in the direction of the optical axis L3 of the laser light, there is nothing but the light emitting member 42. Therefore, the excitation light that is not absorbed by the fluorescent material can be used easily.

Note that, if the GaN-based semiconductor laser element having a wavelength of 405 nm is used as the semiconductor laser element 43, similarly to the first embodiment, it is possible to use a mixture of fluorescent materials that are excited by light having a wavelength of 405 nm and respectively generate red color fluorescent light (e.g., $Y_2O_2S:Eu^{3+}$), green color fluorescent light (e.g., ZnS:Cu,Al), and blue color fluorescent light (e.g., $(Sr,Ca,Ba,Mg)_{10}(PO_4)_6:Eu^{2+}$) at a ratio such that a mixed color of the respective fluorescent light rays becomes white color.

In particular, according to the lighting apparatus 3 of this embodiment, the same effect as in the lighting apparatus 1 of the first embodiment is obtained, and in addition, the following unique effect can be obtained.

The through hole 41*c* is formed in the apex part of the reflective member 41, and hence an optical loss of the reflective member becomes smaller than the case where the through hole is formed in the side surface part.

Figure 12:
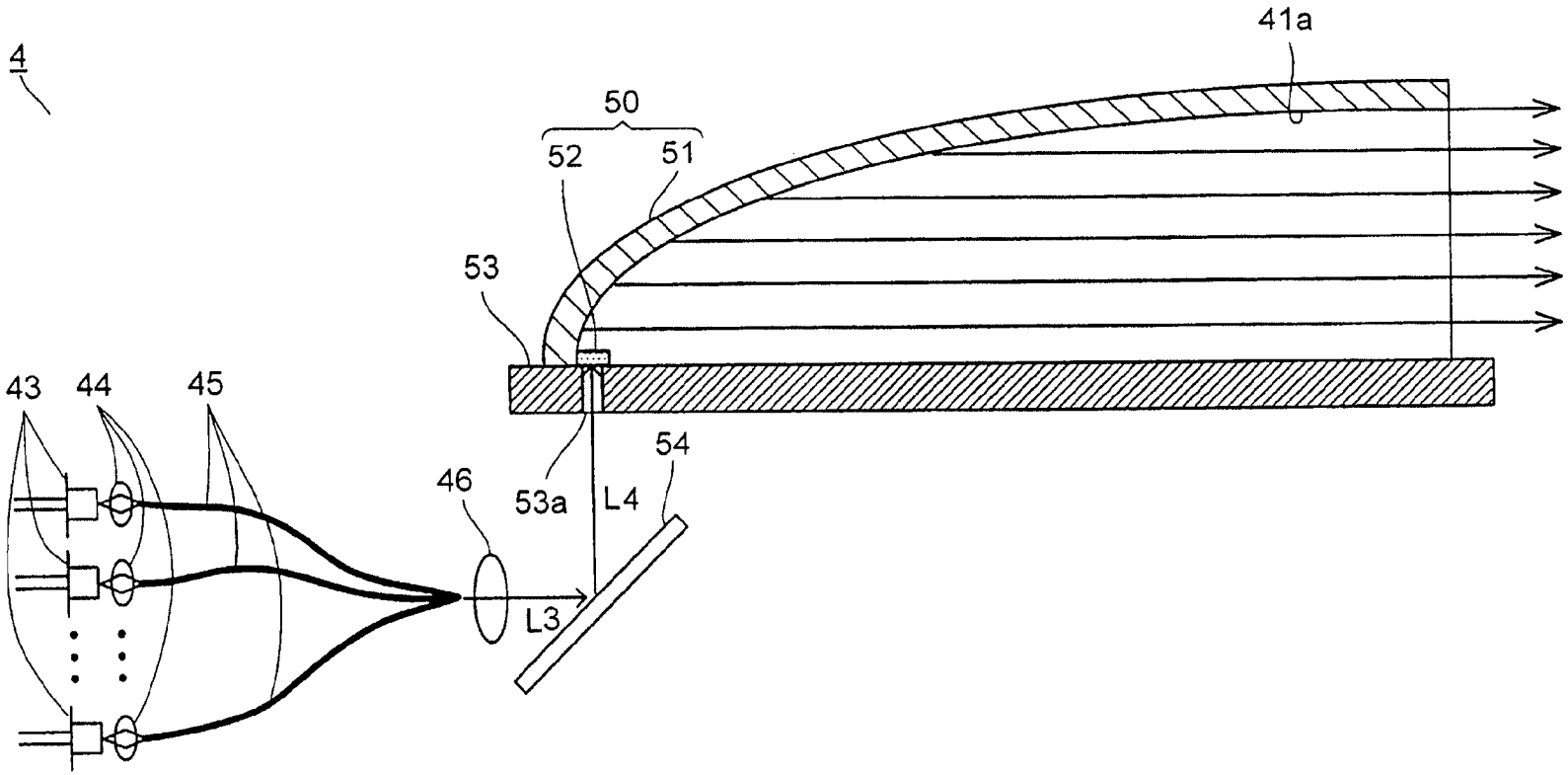
FIG. 12 is a side cross sectional view illustrating a schematic configuration of a lighting apparatus according to a fourth embodiment.

Next, a fourth embodiment of the lighting apparatus is described. FIG. 12 is a side cross sectional view illustrating a schematic configuration of the lighting apparatus of the fourth embodiment.

As illustrated in FIG. 12, in this embodiment, a lighting apparatus 4 includes a light projection structure 50 of the present invention, and a reflective member 51 of the light projection structure 50 has a reflective surface 51*a*. The reflective surface 51*a* has such a shape that is cut by a plane including an axis connecting the apex of a paraboloid of revolution and the focal point. The reflective member 51 is disposed on a metal substrate 53.

The reflective member 51 reflects light emitted from a light emitting member 52 and projects parallel rays to the front. The reflective member 51 can be manufactured, for example, by molding a resin substrate having a concave surface corresponding to the reflective surface shape, and by forming a metal layer on the concave surface of the substrate by plating or vapor deposition.

As to the size of the reflective member 51, the exit is a semicircle having a radius of 25 mm, and the depth is 120 mm. This is half the size of the reflective member 41 used in the third embodiment.

The light emitting member 52 is the same as the light emitting member 42 used in the third embodiment. The side surface part of the light emitting member 52 is mounted onto the apex part of the reflective surface 51*a* with a high thermal conductivity adhesive. Note that, it is possible to mount the bottom surface part of the light emitting member 52 onto the substrate 53 with a high thermal conductivity adhesive. In this case, the light emitting member 52 can be securely fixed because the adhesion area is increased.

The substrate 53 has a through hole 53*a* for the laser light to irradiate the apex part of the reflective surface 51*a*. In this embodiment, the through hole 53*a* is a round hole having a diameter smaller than 4 mm.

Other configuration of the lighting apparatus 4 of this embodiment is the same as that in the third embodiment. Note that, in FIG. 12, a reflector plate 54 is disposed for reflecting the laser light collimated by the collimator lens 46 to pass through the through hole 53*a*.

In particular, according to the lighting apparatus 4 of this embodiment, the same effect as in the lighting apparatus 1 of the first embodiment is obtained, and in addition, the following unique effect can be obtained.

Because the reflective surface 51*a* of the reflective member 51 is half the size of the paraboloid of revolution, the lighting apparatus can be more compact.

In addition, heat generated by the light emitting member 52 can be radiated not only via the reflective member 51 but also via the metal substrate 53. Therefore, thermal quenching of the fluorescent material can be reduced more effectively.

In addition, according to the lighting apparatus 4 of this embodiment, the reflective member 51 has no through hole so that the reflective surface 51*a* can be used completely. Therefore, the reflective member 51 has little optical loss.

<Application Example of Lighting Apparatus>

According to the lighting apparatus of the above-mentioned embodiments, white color light can be projected as substantially parallel rays. Therefore, the lighting apparatus has high utility value as a headlight of a moving body. The moving body includes vehicles such as a bicycle, a car, and a railway car as well as an airplane, a ship, a submarine, and the like.

<Modification of Light Projection Structure>

In the above-mentioned embodiments, the reflective member used for the light projection structure of the present invention has the parabolic reflective surface, but the reflective member to which the present invention is applied is not limited thereto. The present invention can be similarly applied to any other reflective member with a deep concave reflective surface having the focal point positioned near the apex. In addition, it is also possible to use a reflective member having a composite reflective surface of paraboloid shapes. For instance, a compound parabolic concentrator (CPC) type mirror can be used.

The lighting apparatus according to the present invention is described above with reference to specific embodiments, but the present invention is not dependent on a type of the excitation light source, the wavelength and power of the excitation light, a type of the fluorescent material, or a method of guiding the laser light to the fluorescent material.

For instance, in the above-mentioned embodiments, the semiconductor laser element is used as the excitation light source. However, it is possible to use a light emitting diode, a solid-state laser, or a gas laser.

In addition, in the above-mentioned embodiments, the plurality of semiconductor laser elements have the same natural wavelength. However, it is possible to use a combination of semiconductor laser elements having different natural wavelengths so as to realize colors necessary as illumination light. For instance, it is conceivable to use two semiconductor laser elements having natural wavelengths of 405 nm (violet color) and 650 nm (red color), and to use the fluorescent material of SiAlON (blue-green color). The SiAlON fluorescent material is excited by the 405 nm laser light to emit blue-green color light, and lack of red color is compensated by the 650 nm semiconductor laser element.

The present invention can be used for various lighting apparatus such as a headlight and a light source for spot light.

What is claimed is:

1. A light projection structure, comprising:

a reflective member including a reflective surface, the reflective surface being formed as a deep concave surface having a focal point positioned near its apex; and a light emitting member disposed at the focal point and its vicinity, for emitting light when excited by excitation light, wherein the light emitting member comprises a fluorescent material, the excitation light comprises laser light, the fluorescent material of the light emitting member is adhesively attached to and at a bottom of the deep concave surface of the reflective member, and a light source emitting the excitation light is disposed outside the reflective member.

2. A light projection structure according to claim 1, wherein the reflective surface is formed in a paraboloid of revolution.

3. A light projection structure according to claim 2, wherein the reflective surface is formed in such a shape that is cut by a plane including an axis connecting the apex and the focal point.

4. A lighting apparatus, comprising:

the light projection structure according to claim 1; and the light source emitting the excitation light.

* * * * *